US011879672B2

(12) United States Patent
Zeidman

(10) Patent No.: US 11,879,672 B2
(45) Date of Patent: Jan. 23, 2024

(54) AIR CONDITIONING SYSTEM

(71) Applicant: Moshe Zeidman, Rishon LeTsiyon (IL)

(72) Inventor: Moshe Zeidman, Rishon LeTsiyon (IL)

( * ) Notice: Subject to any disclaimer, the term of this patent is extended or adjusted under 35 U.S.C. 154(b) by 0 days.

(21) Appl. No.: 17/645,757

(22) Filed: Dec. 23, 2021

(65) Prior Publication Data

US 2023/0204264 A1 Jun. 29, 2023

(51) Int. Cl.
*F25B 27/00* (2006.01)
*F25B 39/02* (2006.01)

(52) U.S. Cl.
CPC ..... *F25B 27/002* (2013.01); *F25B 39/02* (2013.01)

(58) Field of Classification Search
CPC .. F25B 27/002; F25B 39/02; F25B 2339/047; F25B 2313/004
See application file for complete search history.

(56) References Cited

U.S. PATENT DOCUMENTS

| | | | | |
|---|---|---|---|---|
| 11,421,920 | B2 * | 8/2022 | Qadir | F24H 15/238 |
| 2019/0093959 | A1 * | 3/2019 | Yue | F25B 25/005 |
| 2020/0393173 | A1 * | 12/2020 | Temple | F25B 41/22 |
| 2021/0252940 | A1 * | 8/2021 | Heyl | B60H 1/26 |

FOREIGN PATENT DOCUMENTS

KR 20180009252 A * 1/2018 ..... F25B 41/31

OTHER PUBLICATIONS

Pdf is original document of foreign reference KR 20180009252 A (Year: 2018).*

* cited by examiner

*Primary Examiner* — Len Tran
*Assistant Examiner* — Kamran Tavakoldavani
(74) *Attorney, Agent, or Firm* — Patshegen IP; Moshe Pinchas

(57) ABSTRACT

An air conditioning system is provided and including a solar heat generator configured for collecting solar radiation and for heating fluid by the solar radiation and a fluid container coupled to the solar heat generator and being configured to maintain the heated fluid. The system further includes a heat exchanger disposed inside the fluid container and being configured for transferring heat from the heated fluid to refrigerant inside the heat exchanger, the heat exchanger is configured to increase pressure and temperature of the refrigerant. The system further includes a condenser, an expansion member and an evaporator configured to form together with the heat exchanger an air-conditioning cycle.

16 Claims, 3 Drawing Sheets

AIR CONDITIONING SYSTEM

FIELD OF INVENTION

The presently disclosed subject matter relates to a system for an air conditioning system generated by solar energy.

BACKGROUND

The market for alternative power production using renewable sources is growing owing to advances in materials, the tremendous reduction in costs of such systems, and the growing desire to use means other than fossil fuels. The most plentiful of these resources is the Sun and there are several ways to generate electricity making use of it. Currently, the lowest cost of these is to devise a system using PhotoVoltaic (PV) panels.

The drive to use renewable energy sources has led to a number of innovations in using environmental energy sources.

Cooling in traditional AC systems is accomplished using the vapor-compression cycle, which uses the forced circulation and phase change of a refrigerant between gas and liquid to transfer heat. The vapor-compression cycle can occur within a unitary, or packaged piece of equipment; or within a chiller that is connected to terminal cooling equipment (such as a fan coil unit in an air handler) on its evaporator side and heat rejection equipment such as a cooling tower on its condenser side. An air source heat pump shares many components with an air conditioning system, but includes a reversing valve which allows the unit to be used to heat as well as cool a space.

SUMMARY OF INVENTION

There is provided in accordance with an aspect of the presently disclosed subject matter an air conditioning system. The system includes a solar heat generator configured for collecting solar radiation and for heating fluid by the solar radiation and a fluid container coupled to the solar heat generator and being configured to maintain the heated fluid. The system further includes a heat exchanger disposed inside the fluid container and being configured for transferring heat from the heated fluid to refrigerant inside the heat exchanger, the heat exchanger is configured to increase pressure and temperature of the refrigerant.

The system can further include a condenser in fluid communication with the heat exchanger, being configured to convert the refrigerant to a liquid phase, and an expansion member configured to receive the liquid phase of the refrigerant and to cause pressure and temperature drop of the refrigerant and an evaporator disposed upstream from the expansion valve, the evaporator being configured to exchange heat between the refrigerant and surrounding air, shifting thereby the refrigerant to a vapor phase, the evaporator is configured to urge the vapor phase of the refrigerant back to the heat exchanger.

The heat exchanger can include an outlet valve configured to control pressure of the refrigerant inside the heat exchanger.

The outlet valve can be configured to open and allow the refrigerant to exit the heat exchanger when the refrigerant is shifted to a vapor phase.

The heat exchanger can further include an inlet valve configured to control pressure of the refrigerant inside the heat exchanger.

The inlet valve can be configured to allow the refrigerant to enter inside the heat exchanger when vacuum inside the heat exchanger is at a predetermined level.

The heat exchanger can further include an inlet valve configured to control pressure of the refrigerant inside the heat exchanger.

The inlet and outlet valves can be mechanical valve and which are operated by pressure levels inside the heat exchanger.

The system can further include a circulating pump configured to urge refrigerant in vapor phase thereof from the evaporator into the heat exchanger.

The solar heat generator can be a solar panel in fluid communication with the fluid container and being configured to heat fluid and transfer the fluid into the fluid container.

The heat exchanger can be a tank disposed inside the fluid container.

The solar heat generator can be a window pan for installing on building such that solar radiation impinges thereon, and includes a heat receiving element coupled to the window pan and being configured to receive heat from the solar radiation, and a pipeline thermally coupled to the heat receiving element.

The heat receiving element can be a copper plater disposed along a portion of the window pan.

The pipeline can be configured to transfer heated fluid into the fluid container.

The window pan can further include an inner space defining the fluid container and wherein the pipeline is configured to hold the refrigerant and wherein a portion of the pipeline defines the heat exchanger.

The pipeline can further extend from the inner space to the condenser, and includes an outlet valve controlling the flow of the refrigerant to the condenser.

The system can further include a turbine configured to receive refrigerant from the heat exchange and to convert excess pressure to electrical energy.

The condenser can be configured to reduce excess pressure of the refrigerant by heat dissipation.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1:
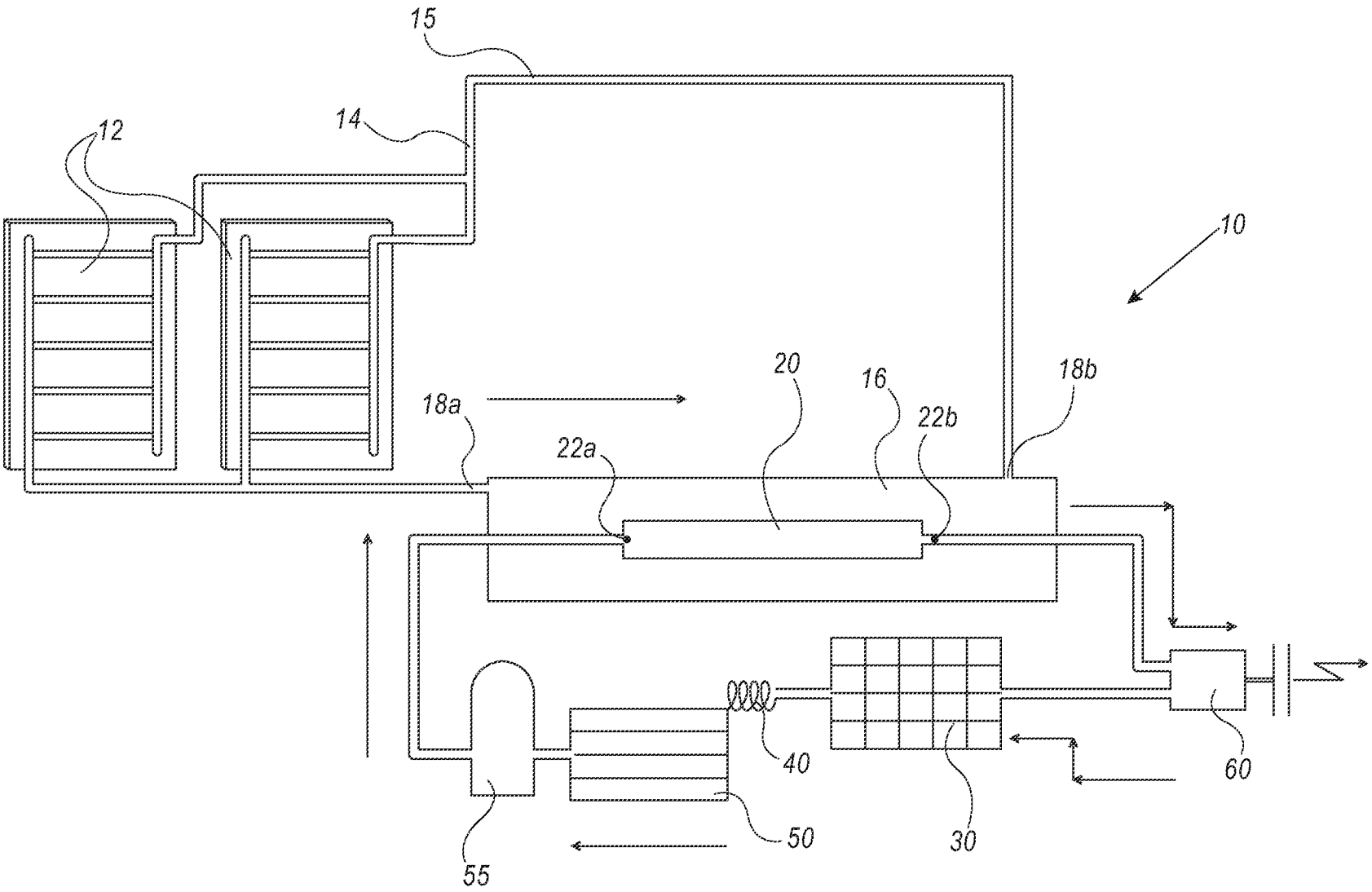
FIG. 1 is block diagram illustration of the air conditioning system in accordance with an example of the presently disclosed subject matter.

FIG. 1 shows an air conditioning system 10, including a solar heat generator 12 configured for collecting solar radiation and for heating fluid 15 by the solar radiation. According to the illustrated example, the solar heat generator 12 is one or more solar panels for installing on a building roof (not shown) or other locations, such that solar radiation impinges thereon. The solar panel 12 includes fluid pipes 14 configured for heating fluid 15 therein by the solar radiation.

According to the illustrated example the fluid pipes 14 extend along an undulated path inside the solar panel 12, so as to increase the length of the path of the pipes along the solar panel 12 increasing thereby the exposure of the fluid inside the pipes 14 to the heat of absorbed by the solar panel 12.

The system 10 further includes a fluid container 16 in fluid communication with the fluid pipes 14, and having an inlet 18*a* configured to receive heated fluid from the solar panels 12 and an outlet 18*b* configured to transfer fluid back to the solar panel 12.

The system 10 further includes a heat exchanger 20 disposed inside the fluid container 16 and being configured for transferring heat from the heated fluid 15 inside the container 16 to refrigerant inside the heat exchanger 20.

The pipes 14, the container 16 and the fluid therein thus serves as a heat transferring mechanism for transferring heat from the solar panel 12 to the heat exchanger 20. The heat exchanger 20 in return heat the refrigerant and cools off the fluid 15 inside the container 16. The pipes 14 extends from the container 16 back towards the solar panels 12 in a close loop to heat the fluid 15 again. It would be appreciated that the pipes 14 which extend back to the solar panels 12 can be provided with a pump facilitating urging the fluid 15 back to the solar panels 12.

The heat exchanger 20, which according to the present example is an inner tank inside the container 16, is configured to increase pressure and temperature of the refrigerant therein. For example, the heat exchanger 20 includes and inlet valve 22*a* and an outlet valve 22*b* configured to control the inlet and outlet flow of the refrigerant in and out of the heat exchanger 20. The outlet valve 22*b* can be configured to open only after the pressure inside of the heat exchanger 20 has reached a predefined level. Similarly, the inlet valve 22*a* can remined closed such that when refrigerant is released under pressure through the outlet valve 22*b* vacuum is formed inside the heat exchanger 20. The inlet valve 22*a* can be configured to open and let refrigerant enter the heat exchanger 20 when vacuum level has reached as predetermined level. This action is explained in detail hereinafter with regards to the inlet of refrigerant into the heat exchanger 20.

As a result of the heating of the refrigerant and the pressure built up inside the heat exchanger 20, the heat exchanger 20 can be used to perform the action of a compressor in known air conditioning systems. That is to say, heat exchanger 20 is configured to increases the density of the incoming refrigerant vapor, causing it to increase in pressure and temperature. The system 10 can further includes a condenser 30 in fluid communication with the heat exchanger 20, being configured to convert the refrigerant to a liquid phase. In other words, the high-pressure vapor exists the heat exchanger 20 and travels into the condenser 30 which can include a series of coils with thin metal fins and a fan which blows air over the fins. This way heat moves from the vapor refrigerant to the fins and into the air stream. The air that is run over the condenser coils is vented to the building exterior and is released to the atmosphere. As a result, the refrigerant vapor loses a significant amount of heat and it subsequently changes phase from a gas to a high temperature liquid.

Furthermore, the system 10 can include an expansion member 40, such as an expansion valve which is configured to receive the liquid phase of the refrigerant and to cause pressure and temperature drop of the refrigerant. In other words, when the liquid refrigerant is then forced through an expansion valve 40 the liquid refrigerant forms a mist. The sudden pressure drop and material expansion when the liquid refrigerant turns into a mist results in a rapid cooling of the refrigerant as it throws off heat energy.

Furthermore, the system 10 can include an evaporator 50 disposed upstream from the expansion valve 40, the evaporator 50 is configured to exchange heat between the refrigerant mist and surrounding air, shifting thereby the refrigerant to a vapor phase. The evaporator 50 can include a circulation fan (not shown) which pulls air from within the building, and which pushes the air across the cold coils of the evaporator 50. Consequently, the cold coils of the evaporator 50 pull heat from the air, causing the air to cool. The transfer of heat to the refrigerant causes it to change back into a warm vapor.

Finally, the evaporator is configured to urge the vapor phase of the refrigerant back to the heat exchanger 20. As indicated hereinabove, the vapor phase of the refrigerant can be urged into the heat exchanger 20, for example by forming vacuum inside the heat exchanger 20. Thus, when the inlet valve 22*a* opens the vacuum sucks the vapor refrigerant from the evaporator 50 to the heat exchanger 20.

According to another example, the system 10 can further includes a circulating pump 55, which is configured to urge the vapor refrigerant from the evaporator 50 to the heat exchanger 20.

It would be appreciated that the inlet and outlet valves 22*a* and 22*b* can be mechanical valves configured to open and close in response to certain pressure thresholds. Otherwise, the inlet and outlet valves 22*a* and 22*b* can be electrical or pneumatic valves controlled by an electronic controller. For example the controller can be configured to synchronize the operation of the inlet and outlet valves 22*a* and 22*b* and the circulating pump 55, such that each one of these elements operates in a timely fashion to form a repetitive closed loop cycle. The system can further include sensors, such as temperature and pressure sensors inside the heat exchanger 20 and at other locations in the system facilitating thereby the operation of the inlet and outlet valves 22*a* and 22*b*. This way, the heat exchanger 20 provides the required level of pressure so as to allow the completion of the air conditioning cycle.

According to an example the system 10 can further include a turbine 60 configured to convert rotating motion to electricity. The turbine 60 is coupled to outlet valves 22*a* and is configured to receive vapored refrigerant from the heat exchanger 20 such that the pressurized refrigerant rotates the turbine 60. Electricity from the turbine can be used to operate various elements of the system 10, such as the fans of the evaporator 50 and the condenser 30, the circulating pump 55 or the controller, or other devices in the building.

The refrigerant can be selected such that its thermodynamic properties allow pressure increase in response to heating by the fluid 15 in the fluid container 16. For example, if the temperature of the refrigerant is below evaporating points the refrigerant is in its liquid state, the refrigerant can be heated by the fluid inside the container 16 to its evaporating point increasing thereby the pressure in the heat exchanger 20.

Moreover, it is desired to use refrigerant which has a relatively high PSI difference between its liquid state and vapor state, such that shifting the refrigerant to its vapor states provides high pressure. More particular, in order to provide sufficient pressure it is desired that the pressure obtained in the vapor state is between 195-300 PSI, such that pressure drop provide sufficient temperature gradient.

An example of such gas is Freon Refrigerant—R240 which has an evaporating temperature of 70° Celsius, and its condensing temperature is 38° Celsius at 200 PSI. Freon Refrigerant—R240 further has an expansion coefficient gas which provides high pressure of 300 PSI and more when the gas is converted to its gaseous state.

It would be appreciated by those skilled in the art that from an energy efficiency point of view, it is desired to select a gas which has a minimal temperature difference between the vapor state and the liquid state of the gas.

In the present case, the pressure difference between the pressure inside the heat exchanger 20 and the expansion member 40 can be configured to be the same as in regular air conditioning systems which is about 120 PSI. However, since according to the present invention the pressure in the heat exchanger 20 is obtained by the heating of the refrigerant, it might be difficult to obtain the exact required pressure. This is especially true sine the heating of the refrigerant may depend on the amount of available solar energy and may vary depending on the hours of the day. Thus, according to an example the turbine 60 can be used for reducing the pressure at the outlet valve 22*b*, by converting some of the excess pressure to electrical energy. In addition, the condenser 30 can also be configured to eliminate excess heat, more than corresponding condensers in regular air conditioning systems.

According to another example, the system can include a three-way valve (not shown) which is configured to selectively direct the vapor refrigerant from the outlet valve 22*b* to either the turbine 60 or the condenser 30. In other words, the three-way valve can be configured to detect the pressure level of the vapor refrigerant, and if the pressure is above a predetermined threshold, the three-way valve directs the vapor refrigerant to the turbine 60 which utilizes the excess pressure to create electricity and then directs the vapor refrigerant to the condenser 30. Otherwise, if the pressure of the vapor refrigerant is below the predetermined threshold, the three-way valve directs the vapor refrigerant directly to the condenser 30.

Alternatively, Freon Refrigerant R410 can be used, which is substantially the same as Freon Refrigerant—R240, however has a higher expansion coefficient, thus allowing utilizing less amount of gas to reach the same rate of PSI.

In other words, the refrigerant is selected such that its thermodynamic properties allow the refrigerant to evaporate and built up significant pressure by the heated fluid in the container 16 and to increase thereby pressure in the heat exchanger 20. I.e., the refrigerant is selected such it shifts in the system between liquid state and vapor state, thereby providing pressure gradient. This way, when the temperature of the refrigerant is below evaporating points the refrigerant is in its liquid state.

Figure 2:
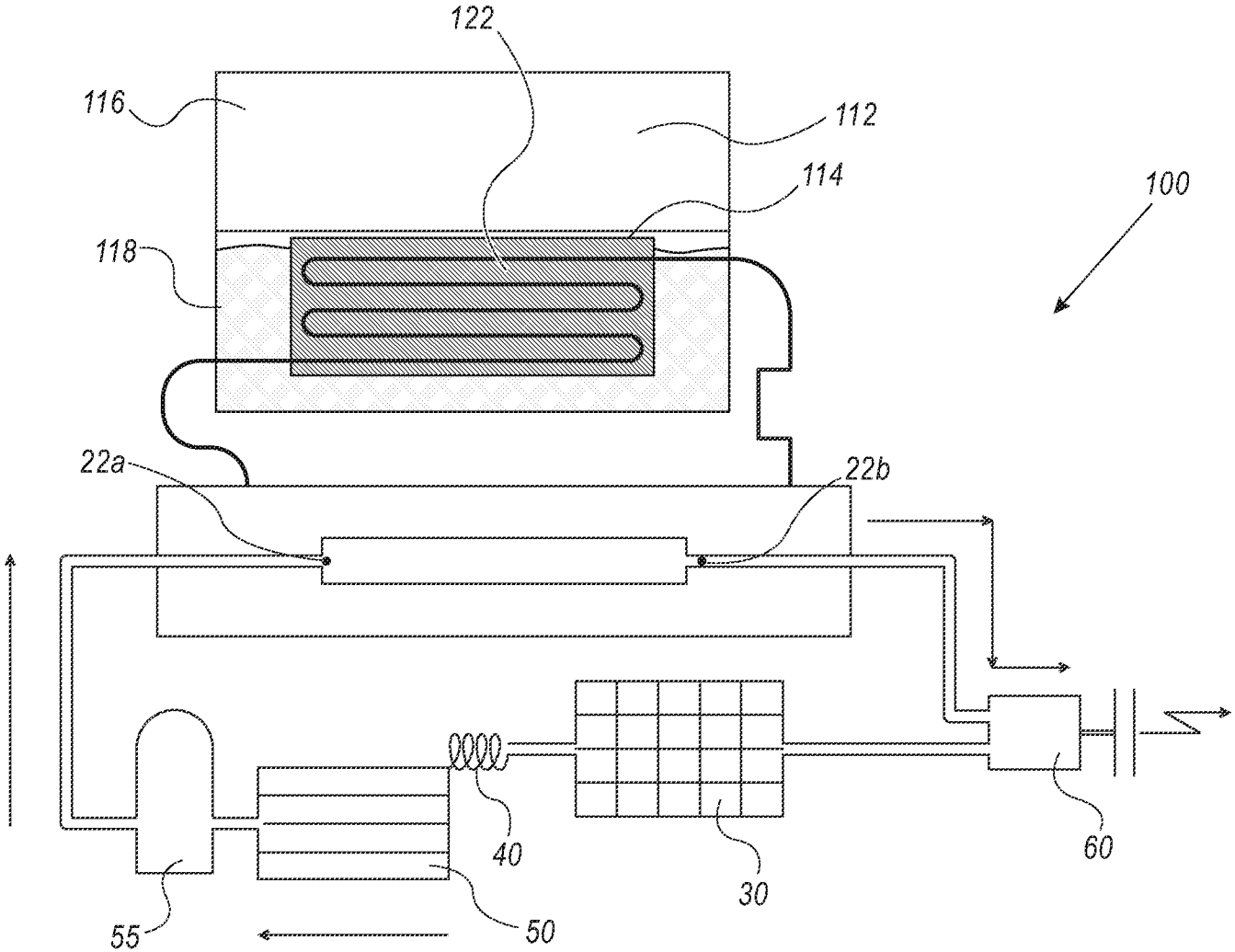
FIG. 2 is a is block diagram illustration of an air conditioning system in accordance with another example of the presently disclosed subject matter.

As shown in FIG. 2, according to another example an air conditioning system 100 can include a solar heat generator 112 in the form or a window pan 112 for installing on building (not shown) such that solar radiation impinges thereon. The window pan can be configured for collecting solar radiation and for heating fluid by the solar radiation. The heated fluid is then transferred to a fluid container 16 which includes a heat exchanger 20. Other elements of the system 100 are the same as the elements of the system 10 of FIG. 1 including inlet and outlet valves 22*a* and 22*b* to control pressure inside the heat exchanger 20, a condenser 30 expansion valve 40 and an evaporator 50.

According to an example, the window pan 112 can be a fully transparent window configured to allow sunlight to be transfer to the building, such that the window serves as a regular window allowing sunlight into the building.

The window pan 112 includes a heat receiving element 114 coupled to the window pan 112 and being configured to receive heat from the solar radiation. According to the illustrated example the window pan 112 includes two pans disposed in parallel with each other and defining an inner space 116 therebetween. The heat receiving element 114 is disposed in the inner space 116 and is configured to collect heat from the solar radiation. According to the illustrated example, the heat receiving element 114 is a metal plate, such as copper, configured to absorbed heat from the solar radiation. It is appreciated that the size of the metal plate can be smaller than the size of the window pan 112. That is to say, since the metal plate blocks light of the solar radiation, the metal plate 114 can be disposed only at a certain portion of the window pan 112 leaving other portions of the window pan 112 exposed, allowing thereby sunlight to enter the building.

According to an example the inner space 116 has vacuum, facilitating thereby heat retention in the window pan 112. According to another example, the inner space 116 includes thermo liquid 118, so as to accumulate the heat of the solar radiation. The thermo liquid 118 is configured to maintain the heat accumulated during the day light hours and to heat the metal plate 114 when no solar heat is available. This way, the system 100 produces the energy required for the air-conditioning cycle even when there is no immediate solar radiation.

The window pan 112 can further includes a heat transferring member 122, which according to the illustrated example is a pipeline extending along the metal plate 114, and having liquid configured to absorbed heat from the metal plate 114. According to the illustrated example the pipeline 122 extends along an undulated path, so as to increase the length of the path of the pipeline along the metal plate 114 increasing thereby the exposure of the thermo pipeline 122 to the heat of absorbed by the metal plate 114.

The pipeline 122 extends out of the window pan 112 toward the fluid container 16 transferring the heated liquid thereto, which operates as described above in connection with FIG. 1. The pipeline 122 extends from the container 16 back towards the window pan 112 in a close loop to heat the liquid again. To facilitate the flow of the liquid in the pipeline 122 especially the cooled off liquid entering the window pan 112, a liquid pump (not shown) can be integrated in the pipeline 112.

Figure 3:
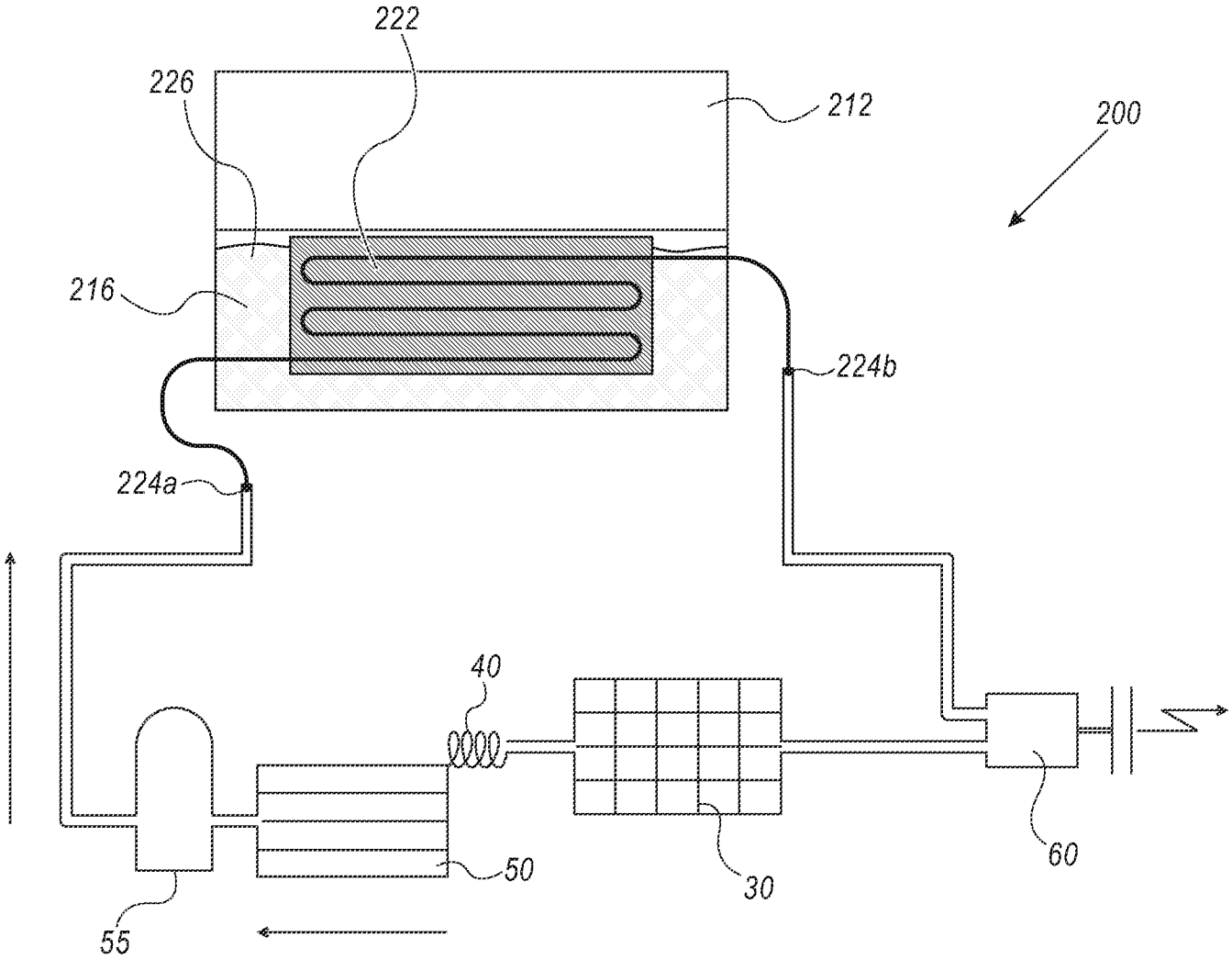
FIG. 3 is a is block diagram illustration of an air conditioning system in accordance with yet another example of the presently disclosed subject matter.

According to yet another example, as shown in FIG. 3, an air conditioning system 200 can include a solar heat generator 212 in the form or a window pan 212, as in the example of FIG. 2. According to this example however, the window pan 212 also serves as a fluid container 216 and the thermo pipeline 222 extending through the window pan 212 serves as a heat exchanger. That is to say, the pipeline 222 is configured to hold therein refrigerant which is heated by the liquid 226 inside the window pan 212. The thermo pipeline 222 includes inlet valve 224*a* and an outlet valve 2224*b*, which control the flow of the refrigerant in and out of the window pan 212.

Accordingly, the pipeline 222 serves as a compressor and controls the pressure build-up of the refrigerant. Thus, according to this example, the pipeline 222 is coupled on one end to a condenser 30 and on the other end to an evaporator 50, to complete an air conditioning cycle, as explained with regards to FIG. 1. Obviously, the air conditioning system 200 can include a turbine 60 to convert some of the pressure in the refrigerant to electricity and a circulating pump 55 urging the liquid refrigerant from the evaporator 50 back into the window pan 212.

Those skilled in the art to which the presently disclosed subject matter pertains will readily appreciate that numerous changes, variations, and modifications can be made without departing from the scope of the invention, mutatis mutandis.

The invention claimed is:

1. An air conditioning system comprising:

a solar heat generator configured for collecting solar radiation and for heating fluid by the solar radiation;

a fluid container in fluid communication with said solar heat generator by a fluid pipe transferring said heated fluid from said solar heat generator into said fluid container;

an inner tank disposed inside said fluid container and containing refrigerant, said inner tank is configured for transferring heat from said heated fluid inside said fluid container to said refrigerant, said inner tank heat exchanger includes outlet valve configured to increase pressure and temperature of said refrigerant inside said inner tank;

a condenser in fluid communication with said inner tank, and being configured receive said refrigerant from said inner tank and to convert said refrigerant to a liquid phase;

an expansion member configured to receive said liquid phase of said refrigerant and to cause a pressure and temperature drop of said refrigerant; and an evaporator disposed upstream from said expansion valve, said evaporator being configured to exchange heat between said refrigerant and surrounding air, shifting thereby said refrigerant to a vapor phase, said evaporator is configured to urge said vapor phase of said refrigerant back to said heat exchanger.

2. The system of claim 1 wherein said outlet valve is configured to open and allow said refrigerant to exit said heat exchanger when said refrigerant is shifted to a vapor phase.

3. The system of claim 1 wherein said heat exchanger further includes an inlet valve configured to control pressure of said refrigerant inside said heat exchanger.

4. The system of claim 1 wherein said inlet valve is configured to allow said refrigerant to enter inside said heat exchanger when vacuum inside said heat exchanger is at a predetermined level.

5. The system of claim 1 wherein said heat exchanger further includes an inlet valve configured to control pressure of said refrigerant inside said heat exchanger.

6. The system of claim 3 wherein said inlet and outlet valves are mechanical valves and which are operated by pressure levels inside the heat exchanger.

7. The system of claim 1 further comprising a circulating pump configured to urge refrigerant in vapor phase thereof from said evaporator into the heat exchanger.

8. The system of claim 1 wherein said solar heat generator is a solar panel in fluid communication with said fluid container and being configured to heat fluid and transfer said fluid into said fluid container.

9. The system of claim 8 wherein said heat exchanger is a tank disposed inside the fluid container.

10. The system of claim 1 wherein said solar heat generator is a window for installing on building such that solar radiation impinges thereon, said window includes a windowpane and a heat receiving element coupled to said windowpane and being configured to receive heat from said solar radiation, and a pipeline thermally coupled to said heat receiving element.

11. The system of claim 10 wherein said heat receiving element is a copper plater disposed along a portion of said windowpane.

12. The system of claim 10 wherein said pipeline is configured to transfer heated fluid into said fluid container.

13. The system of claim 10 wherein said windowpane includes a pair of windowpanes defining an inner space therebetween and wherein said fluid container is the inner space and wherein said pipeline is configured to hold said refrigerant and wherein a portion of said pipeline defines said heat exchanger.

14. The system of claim 13 wherein said pipeline further extends from said inner space to said condenser, and includes an outlet valve controlling the flow of said refrigerant to said condenser.

15. The system of claim 1 further comprising a turbine configured to receive refrigerant from said heat exchange and to convert excess pressure to electrical energy.

16. The system of claim 1 wherein said condenser is configured to reduce excess pressure of said refrigerant by heat dissipation.

* * * * *